US010138617B2

(12) United States Patent
Seidl et al.

(10) Patent No.: US 10,138,617 B2
(45) Date of Patent: Nov. 27, 2018

(54) GROUND-ENGAGEABLE ATTACHMENT FOR A VEHICLE

(71) Applicant: The Charles Machine Works, Inc., Perry, OK (US)

(72) Inventors: Jeff Seidl, Seymour, WI (US); Jordan Mendenhall, Polk, OH (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 15/676,596

(22) Filed: Aug. 14, 2017

(65) Prior Publication Data

US 2018/0044883 A1 Feb. 15, 2018

Related U.S. Application Data

(60) Provisional application No. 62/374,725, filed on Aug. 12, 2016.

(51) Int. Cl.
*E02F 9/08* (2006.01)
*E02F 9/00* (2006.01)

(52) U.S. Cl.
CPC ..... *E02F 9/085* (2013.01); *E02F 9/006* (2013.01)

(58) Field of Classification Search
CPC ..... E02F 9/085; E02F 9/006
See application file for complete search history.

(56) References Cited

U.S. PATENT DOCUMENTS 1,435,920 A * 11/1922 Greenleaf ..... E02F 3/352 37/403
1,840,666 A * 1/1932 Grundon ..... B60T 3/00 188/5
2,155,044 A * 4/1939 Gray ..... B65H 57/18 172/602
2,929,517 A * 3/1960 Phillips ..... B66C 23/80 280/764.1
3,161,306 A * 12/1964 Granryd ..... E02F 3/404 37/442
3,220,579 A * 11/1965 Pilch ..... E02F 3/964 414/694
3,460,690 A * 8/1969 Seifert ..... A01D 87/0053 280/481
3,610,450 A * 10/1971 Demkiw ..... A01D 87/0053 414/697
3,805,980 A * 4/1974 Kisaka ..... B62D 49/02 414/686
3,854,607 A * 12/1974 Kamner ..... E02F 3/3483 180/8.4

(Continued)

OTHER PUBLICATIONS

American Augers, "Trencor Trenchers", catalog, Apr. 2014, 7 pages, West Salem, Ohio.

*Primary Examiner* — Jacob B Meyer
(74) *Attorney, Agent, or Firm* — Tomlinson McKinstry, P.C.

(57) ABSTRACT

A work machine is formed from a self-propelled land travel vehicle and an attachment. The vehicle and attachment have interlocking coupling assemblies. The attachment has a positioning arm, a pivot fixture and a ground-engageable frame. The positioning arm and frame allow the attachment to pivot about the pivot fixture to couple and decouple with the vehicle. Coupling and decoupling of the vehicle and apparatus can be achieved without the use of separate lifting equipment.

21 Claims, 8 Drawing Sheets

(56) References Cited

U.S. PATENT DOCUMENTS 3,912,095 A * 10/1975 Miller ..... E02F 3/6273 172/274
3,939,997 A * 2/1976 Frank ..... E02F 3/6273 172/275
3,982,643 A * 9/1976 MacGregor ..... E02F 3/6273 172/273
3,991,890 A * 11/1976 Frank ..... E02F 3/6273 172/275
4,033,469 A * 7/1977 Frank ..... E02F 3/3645 172/272
4,034,998 A * 7/1977 Iijima ..... E02F 3/384 172/272
4,051,962 A * 10/1977 Westendorf ..... E02F 3/6273 172/275
4,217,075 A * 8/1980 Frank ..... E02F 3/6273 172/274
4,247,242 A * 1/1981 Goertzen ..... A01D 87/0069 280/460.1
4,266,909 A * 5/1981 Langenfeld ..... E02F 3/433 414/700
4,275,984 A * 6/1981 Lenertz ..... E02F 3/968 172/274
4,347,031 A * 8/1982 Friesen ..... B62D 49/02 172/274
4,401,408 A * 8/1983 Gibert ..... E02F 3/30 180/418
4,534,431 A * 8/1985 Aronsson ..... E02F 9/085 180/8.5
4,637,772 A * 1/1987 Stumpe ..... E02F 3/6273 172/274
4,793,764 A * 12/1988 Hamm ..... E02F 3/968 414/686
4,798,511 A * 1/1989 Kaczmarczyk ..... E02F 3/36 414/686
4,921,392 A * 5/1990 Wagner ..... E02F 3/386 212/304
5,232,330 A * 8/1993 Rae ..... E02F 3/6273 414/686
5,482,121 A * 1/1996 Draney ..... E02F 5/103 172/165
5,540,289 A * 7/1996 Hirooka ..... E02F 3/6273 172/273
5,671,554 A * 9/1997 Geelhoed ..... E02F 3/16 172/4.5
6,016,616 A * 1/2000 Geelhoed ..... E02F 3/16 172/2
6,035,941 A * 3/2000 Hirooka ..... B62D 49/02 172/273
6,386,821 B1 * 5/2002 Schneider ..... E02F 3/6273 172/274
6,705,644 B2 * 3/2004 States ..... B66C 23/80 280/764.1
6,725,579 B2 * 4/2004 Unzicker ..... E02F 3/08 37/464
6,729,050 B2 * 5/2004 Whitten ..... E02F 3/08 37/464
6,948,265 B2 * 9/2005 Unzicker ..... E02F 3/08 37/464
6,994,511 B2 * 2/2006 Westendorf ..... E02F 3/3645 414/686
7,654,017 B2 * 2/2010 Black ..... E02F 3/12 37/352
7,950,894 B2 * 5/2011 Rossi ..... E02F 9/2004 414/686
8,544,885 B2 * 10/2013 Lanting ..... E02F 3/968 172/274
8,701,790 B2 * 4/2014 Carothers ..... A01B 13/08 172/40
9,211,832 B1 * 12/2015 Secker ..... B60P 3/12
9,587,370 B2 * 3/2017 Lanting ..... E02F 3/968
9,903,095 B2 * 2/2018 Parker ..... E02F 3/364
2003/0041485 A1 * 3/2003 Whitten ..... E02F 3/08 37/352
2003/0041487 A1 * 3/2003 Unzicker ..... E02F 3/08 37/462
2004/0172864 A1 * 9/2004 Unzicker ..... E02F 3/08 37/352
2005/0008468 A1 * 1/2005 Sugaya ..... B66C 23/80 414/680
2007/0124964 A1 * 6/2007 Wetzel ..... E02F 3/325 37/468
2007/0163788 A1 * 7/2007 Carothers ..... A01B 13/08 172/40
2007/0220783 A1 * 9/2007 Hamburger ..... E02F 3/06 37/464
2010/0170118 A1 * 7/2010 Thomas ..... E02F 3/384 37/403
2011/0062695 A1 * 3/2011 Bergemann ..... B66C 23/80 280/763.1
2016/0263981 A1 * 9/2016 Bunting ..... B60K 3/00
2018/0044883 A1 * 2/2018 Seidl ..... E02F 9/085
2018/0171792 A1 * 6/2018 Moberg ..... B60S 9/12

* cited by examiner

GROUND-ENGAGEABLE ATTACHMENT FOR A VEHICLE

CROSS REFERENCE TO RELATED APPLICATION

This application claims the benefit of U.S. Provisional Patent Application Ser. No. 62/374,725 filed Aug. 12, 2016, the entire contents of which are incorporated herein by reference.

SUMMARY

An apparatus comprises a frame, an elongated positioning arm, a pivot fixture, a coupling assembly, and a ground-engageable work attachment arm. The positioning arm extends from the bottom of the frame and comprises a first end pivotally attached to the frame and a second end supporting an enlarged ground-engageable shoe. The pivot fixture is suspended from the bottom of the frame and comprises a ground-engageable pivot point at its lower extremity. The coupling assembly is configured to join the apparatus to a self-propelled land travel vehicle. The apparatus has no ground-contacting motive elements.

A work machine comprises a chassis, a track frame and a work attachment. The chassis has a rearwardly-disposed cradle assembly. The track frame movably supports the chassis. The work attachment is connected to the cradle assembly of the chassis. The work attachment comprises a frame, an elongated positioning arm, and a pivot fixture. A portion of the frame may be actuated to engage the ground. The positioning arm is pivotally attached to the frame at a first end comprising a ground-engageable shoe at a second end. The pivot fixture is suspended from the bottom of the frame and comprises a ground-engageable pivot point at its lower extremity. The attachment frame has no ground-contacting motive elements.

DETAILED DESCRIPTION

Figure 1:
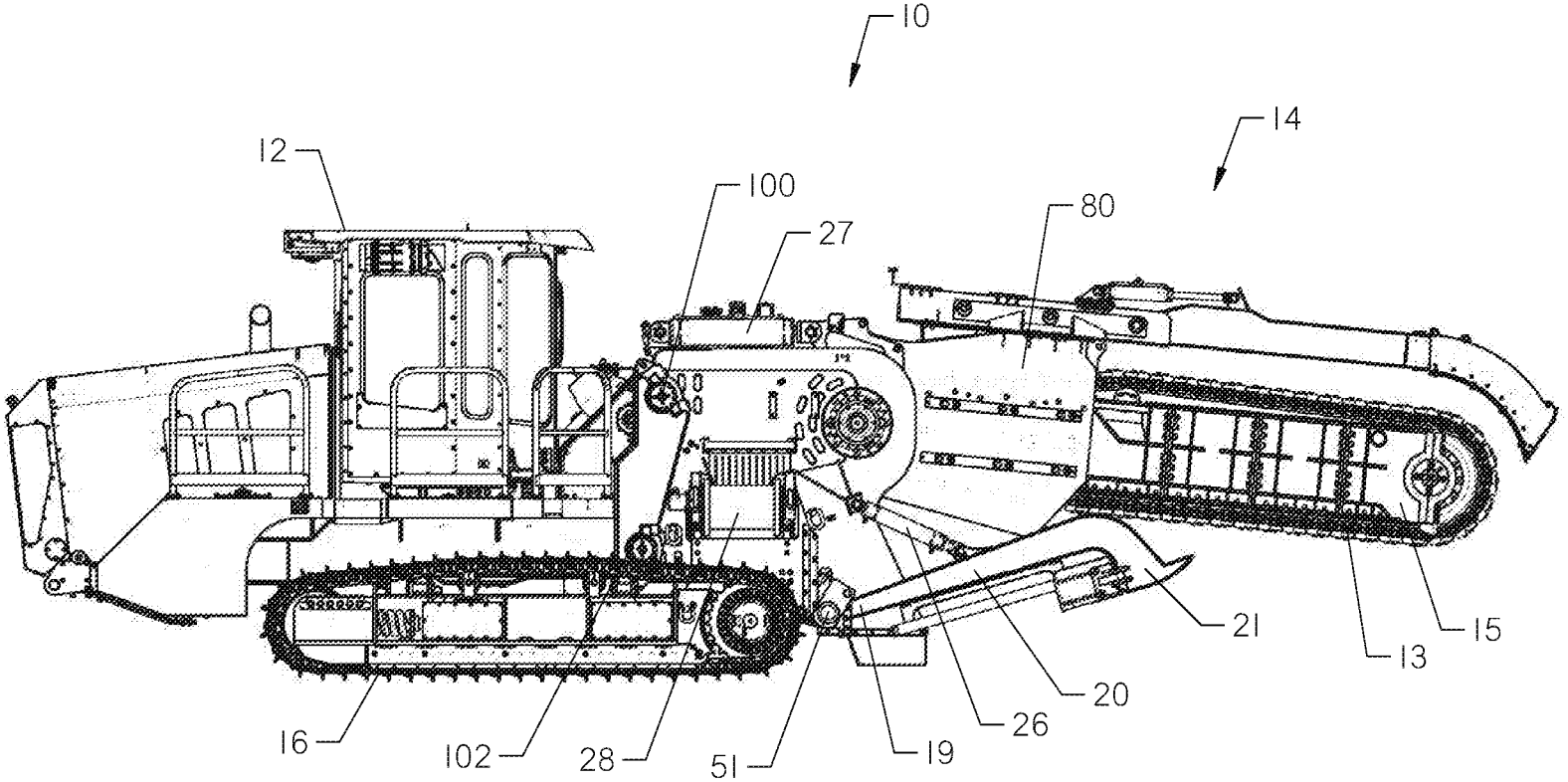
FIG. 1 is a side elevation view of a work machine. The attachment is connected to the vehicle.

FIGS. 1-3 and 5-7 show a work machine 10 with a self-propelled land travel vehicle 12 and an attachment 14. The vehicle 12 is supported on a track assembly 16. The attachment 14 is supported by a retractable pivot fixture 18

(FIG. 2) and an elongated positioning arm 20. The attachment 14 shown in the Figures is a trencher. It includes a frame 80 having a ground-engageable arm 15, which supports an endless chain 13, which may be selectively positionable on the ground. Other attachments usable in the work machine 10 include, but are not limited to, a dirt trencher, rock trencher, bucket wheel, rock saw or cable plow. Typically, work attachments 14 have no ground contacting motive elements.

The ground-engageable arm 15 as discussed herein is largely used to manipulate or lift the position of the attachment 14. However, the arm 15 may be an operable portion of the work machine 10. When assembled, as shown in FIG. 1, the arm 15 is used to uncover a trench through operation of the work machine 10.

Hydraulic lines (not shown) connect motor 28 on the attachment 14 with the prime mover of the vehicle 12. The attachment 14 and vehicle 12 are connected at a coupling assembly 100. The coupling assembly 100 may comprise a cradle array 102 located at a rearwardly-disposed portion of the vehicle 12 and a rod array 104 (FIG. 2) disposed on the attachment 14.

The positioning arm 20 may be raised and lowered by a hydraulically-actuated arm cylinder 26. The ground-engaging arm 15 may be raised and lowered by a hydraulically-actuated frame cylinder 27. The motor 28 may power the frame cylinder 27 and the arm cylinder 26. The arm 20, frame cylinder 27, and arm cylinder 26 are preferably duplicated on each side of the attachment 14.

Figure 2:
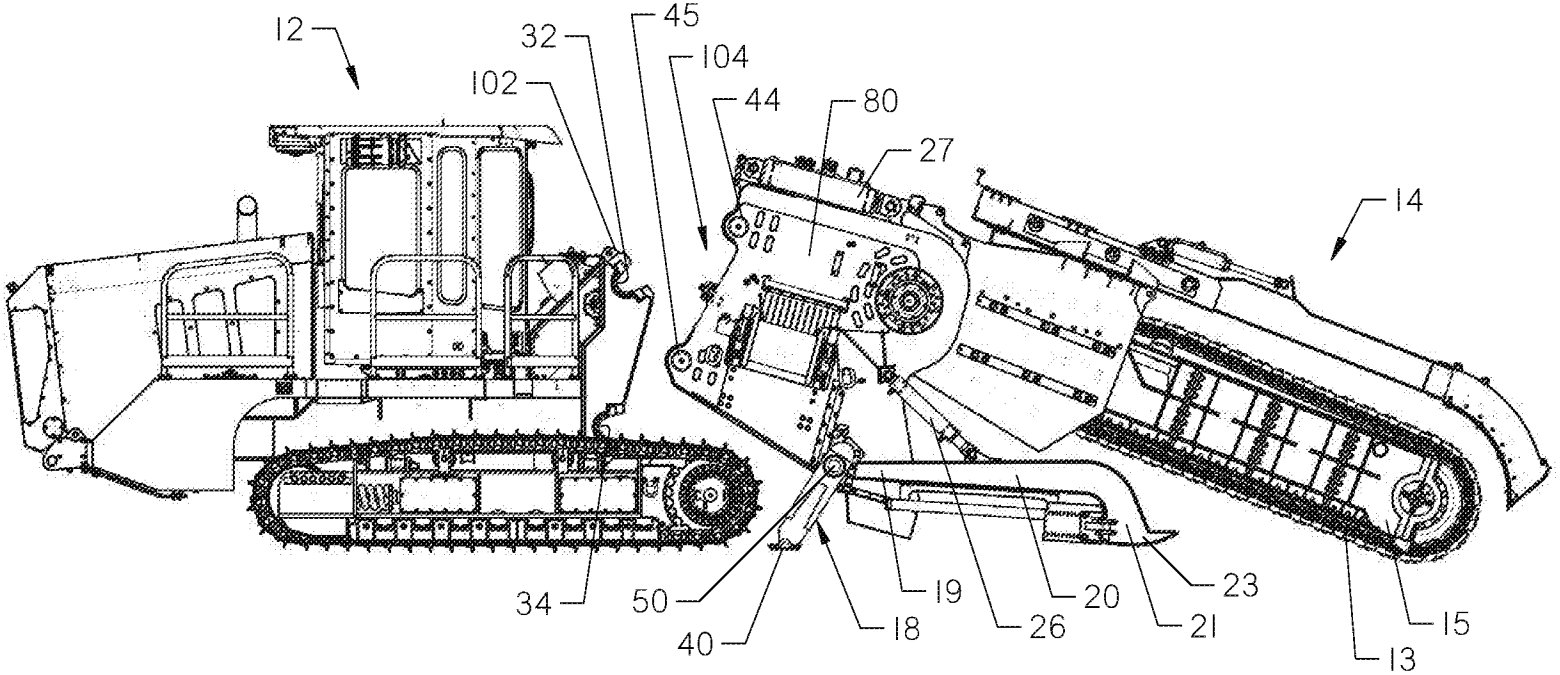
FIG. 2 is a side elevation view of the work machine of FIG. 1. The attachment is disconnected from the vehicle.
Figure 3:
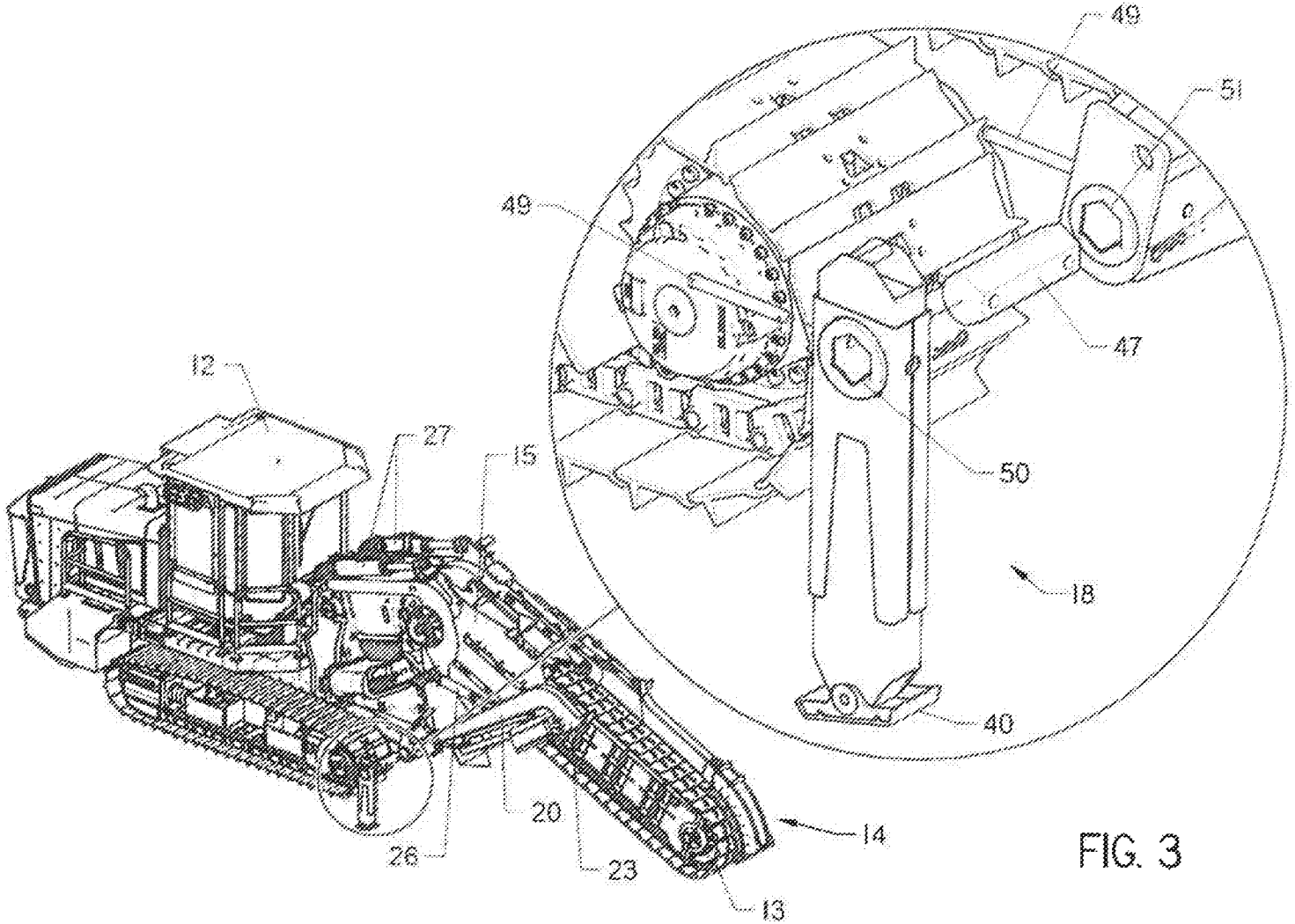
FIG. 3 is a perspective view of the work machine of FIG. 1 including a detailed view of a pivot fixture and its point of connection to the attachment.

With reference now to FIGS. 2 and 3, the attachment 14 and vehicle 12 are shown as detached. The attachment 14 is supported by a pivot fixture 18 and the positioning arm 20. Support for the attachment 14 while decoupled and free-standing can be supplemented by the ground-engageable arm 15. The pivot fixture 18 comprises a ground-engageable pivot foot 40. The ground-engageable pivot foot 40 is located at the lower extremity of the pivot fixture 18 and contacts the ground during the coupling process. The pivot foot 40 is preferably flat to provide support for the attachment 14 when free-standing, but allows rotation over the ground-engageable pivot foot to aid in coupling of the attachment to the vehicle 12.

The elongated positioning arm 20 comprises a powered arm with a first end 19 pivotally attached to the frame and a second end 21 supporting an enlarged ground-engageable shoe 23. Extension of arm cylinder 26 causes the shoe 23 of positioning arm 20 to engage the ground. Once thus engaged, the positioning arm 20 provides support and stability to the attachment 14 when detached from the vehicle 12. Further, the positioning arm 20 may operate with the arm 15 to pivot the attachment 14 about the pivot foot 40. The shape and size of the elongated positioning arm 20 may vary depending on the shape and size of the attachment 14. The positioning arm 20 may be bent between its first 19 and second ends 21.

The pivot fixture 18 may take a number of different forms. With reference to FIGS. 2 and 3, the pivot fixture 18 is a kickstand device attached to the attachment 14. The pivot fixture 18 may be removably connected to the attachment 14 by means of a shank 47. The shank 47 conforms at one end to a socket 51 formed in the attachment 14, and at the other end to a socket 50 formed in the pivot fixture 18. As shown, the shank 47 and sockets 50, 51 are hexagonal. The shank 47 fits into the sockets 50, 51 and clevis pins 49 or other connectors secure the shank 47 in place. As shown in FIG. 3, two pivot fixtures 18 may be utilized, laterally spaced on the attachment 14. During operation of the work machine 10, the pivot fixture 18 may be removed (FIG. 1) or may be rotated relative to the shank 47 for unobtrusive storage on the attachment 14.

Figure 4:
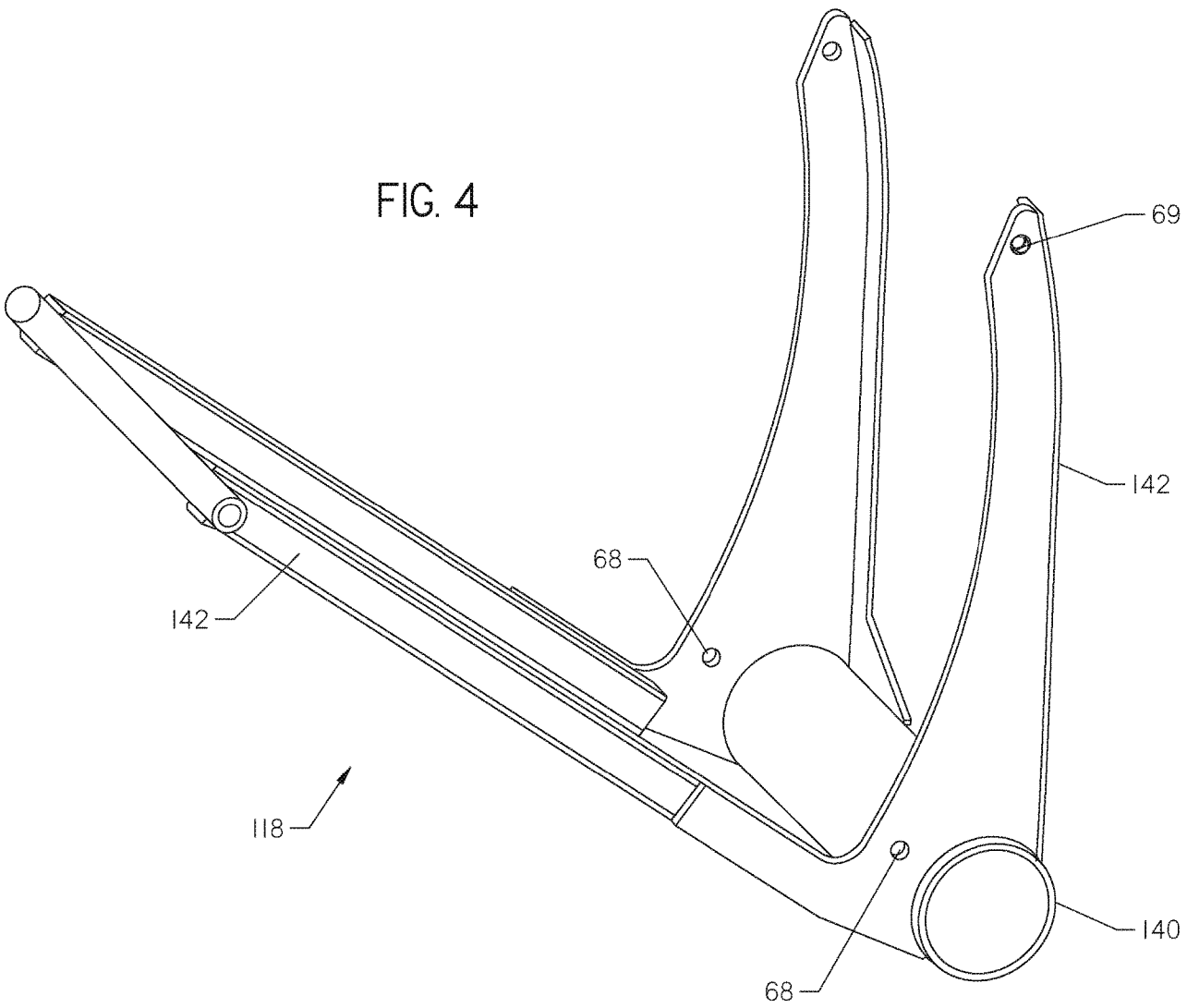
FIG. 4 is a perspective view of an alternative embodiment of a pivot fixture.

With reference to FIG. 4, an alternative embodiment of the pivot fixture 118 is shown. The pivot fixture 118 comprises a ground-engageable pivot point 140 and two legs 142. The legs 150 are joined at pivot point 140 and form a V-shaped structure. The legs 142 may be connected opposite the pivot point 140 to the attachment 14 by pins (not shown). The fixture 118 may extend from below the attachment 14 when the pin is disposed through holes 69. The fixture 118 may be retracted relative to the attachment when the pins are attached to holes 68. When extended, the legs 142 cause the ground-engageable pivot point 140 to extend from the attachment 14. The legs 142 of the pivot fixture 118 create a triangular cross sectional shape of the pivot fixture 118. Thus, the attachment 14 can pivot about the foot 140.

The pivot fixtures 18, 118, may be designed to be retracted or removed when the attachment 14 and vehicle 12 are not in the coupling process. The pivot fixture 18 may alternatively be designed such that it is not retractable or removable but still does not contact the ground while the work machine 10 is not being coupled or decoupled. As shown in FIG. 2, the pivot fixture 18 is suspended from the bottom of the attachment 14 and situated on the opposite side of the first end 19 of the positioning arm 20 from the shoe 23.

With reference again to FIG. 2, the cradle array 102 comprises a top cradle 32 and a bottom cradle 34 formed in the vehicle 12. The rod array 104 further comprises a top rod 44 and a bottom rod 45 disposed on the attachment 14. The top rod 44 conforms to the top cradle 32, while the bottom rod 45 conforms to the bottom cradle 34. While the invention will be discussed with rods formed on the attachment and cradles on the vehicle, an opposite configuration may be utilized without departing from the spirit of the invention.

After arm 15 engages the ground, the attachment 14 may be pivoted around pivot 40 by extension of frame cylinder 27. The positioning arm 20 may be used in concert with the ground-engaging arm 15 to stabilize the attachment 14 during coupling. The attachment 14 is thus pivoted back so that rod 44 is disposed in cradle 32.

Figure 5:
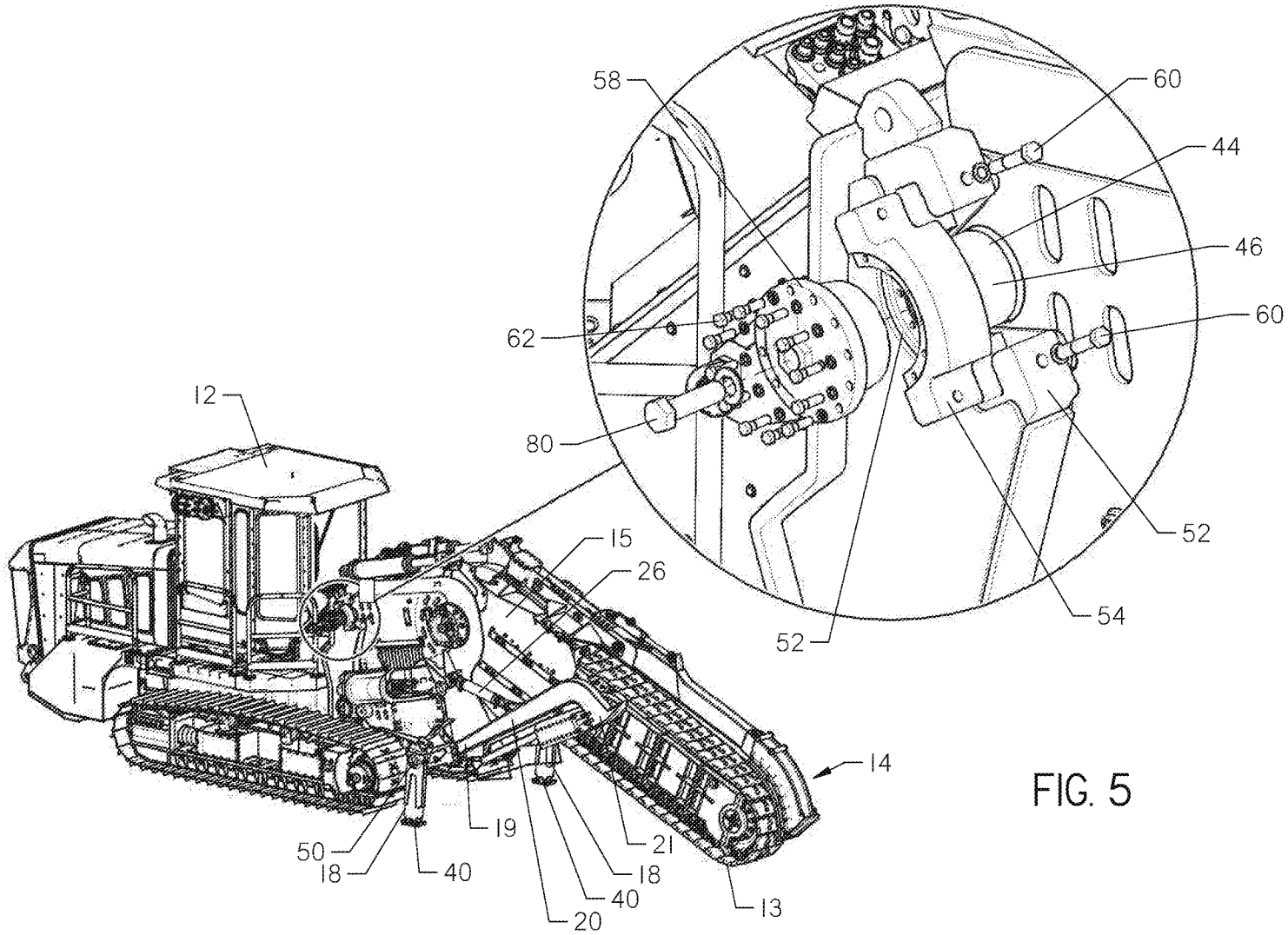
FIG. 5 is a perspective view of the work machine of FIG. 1, including a detailed perspective a detailed perspective view of the coupling assembly.
Figure 6:
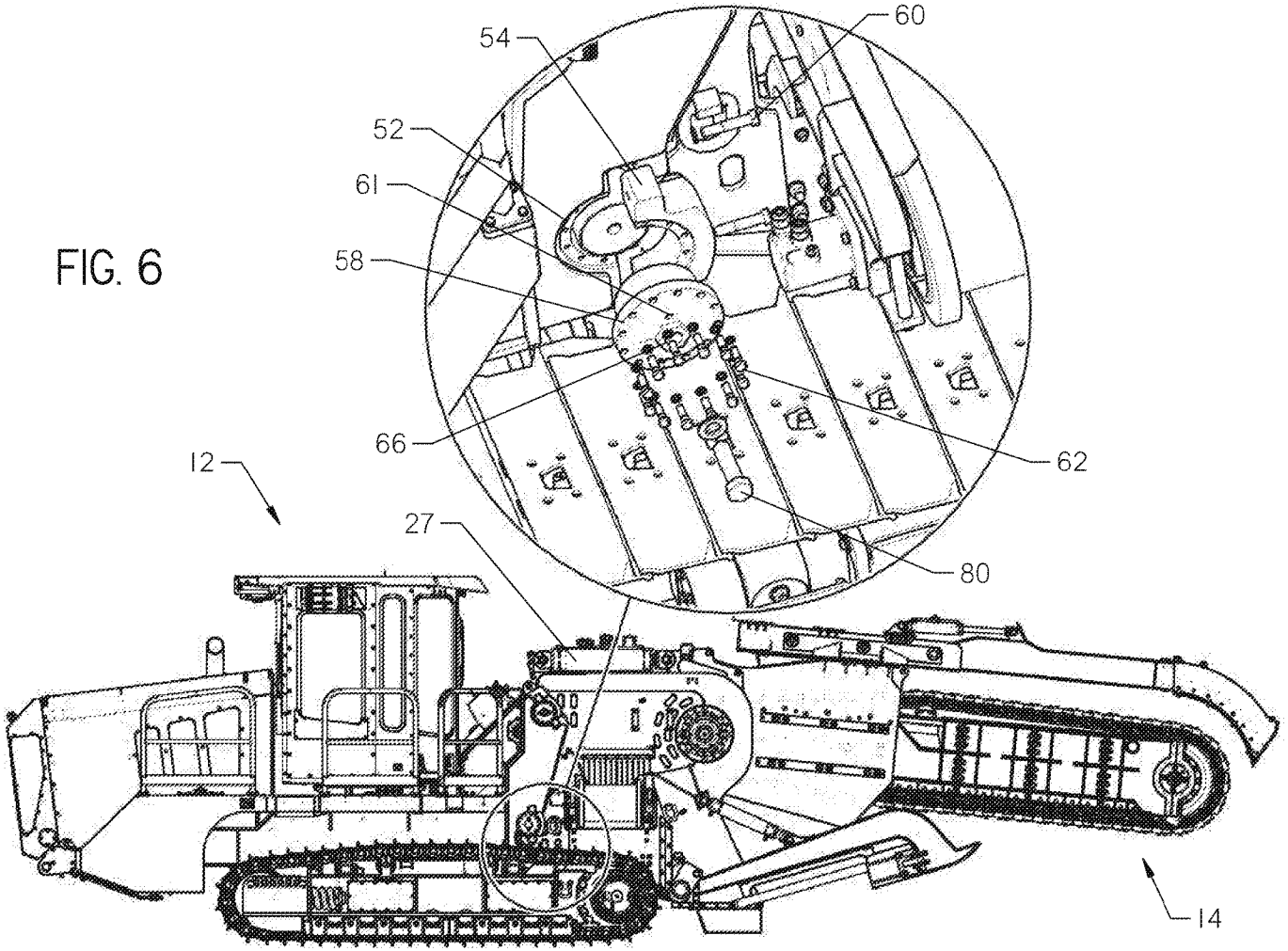
FIG. 6 is a partial side view of the work machine of FIG. 1, including a detailed perspective view of the same coupling assembly shown in FIG. 5.

With reference now to FIGS. 5 and 6, the connection between the top cradle 32 and top rod 44 is shown in detail. The top rod 44 comprises bushings 46 that are affixed to the rods and facilitate connection to the cradle 32. Bushings 46 may also prevent galling of the coupled rods 44, 45 and cradles 32, 34 in the coupling assembly 100. The cradle 32 comprises a fixed component 52, a locking component 54, and an eccentric cap 58. The eccentric caps 58 may further be secured to the fixed component 52 and locking component 54 by securing pins 62. The pins 62 pass through holes in the cap 58 into the fixed component 52 of the cradle 32.

The eccentric cap 58 has a bore 66. The cap 58 secured to the bushing 46 of the rod 44 by a rod bolt 80. The bushing 46 allows relative rotation between the cap 58 and the rod 44, allowing the rod 44 to act as a pivot axis 70 (FIG. 8) for the attachment 14. The cap 58 is designed such that the bore 66 is slightly offset relative to the centerpoint of the cap. This eccentricity facilitates adjustment between the pins 44, 45 and rotation of the pin 44 within the top cradle 32.

The locking component 54 may be secured into place relative to the fixed component 52 by pins 60. In this configuration, the locking component 54 physically surrounds the rod 44 and the cap 58, securing it within the top cradle 32.

While the discussion of FIGS. 5 and 6 has focused on the top cradle 32 and top rod 44, it should be understood that the bottom cradle 34 and bottom rod 45 are configured identically.

Figure 7:
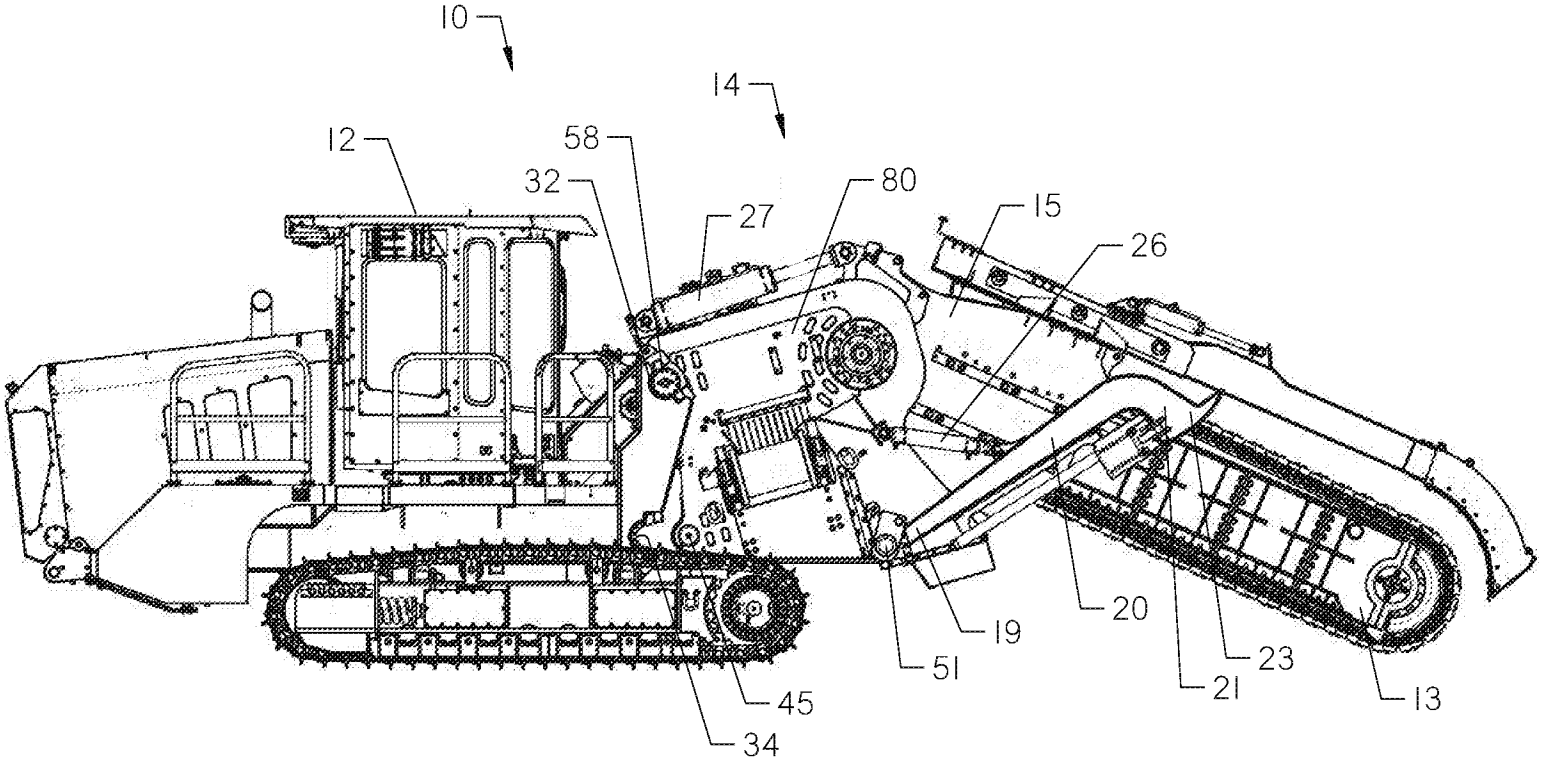
FIG. 7 is a side elevation view of the work machine of claim 1. The attachment is partially disconnected from the vehicle.
Figure 8:
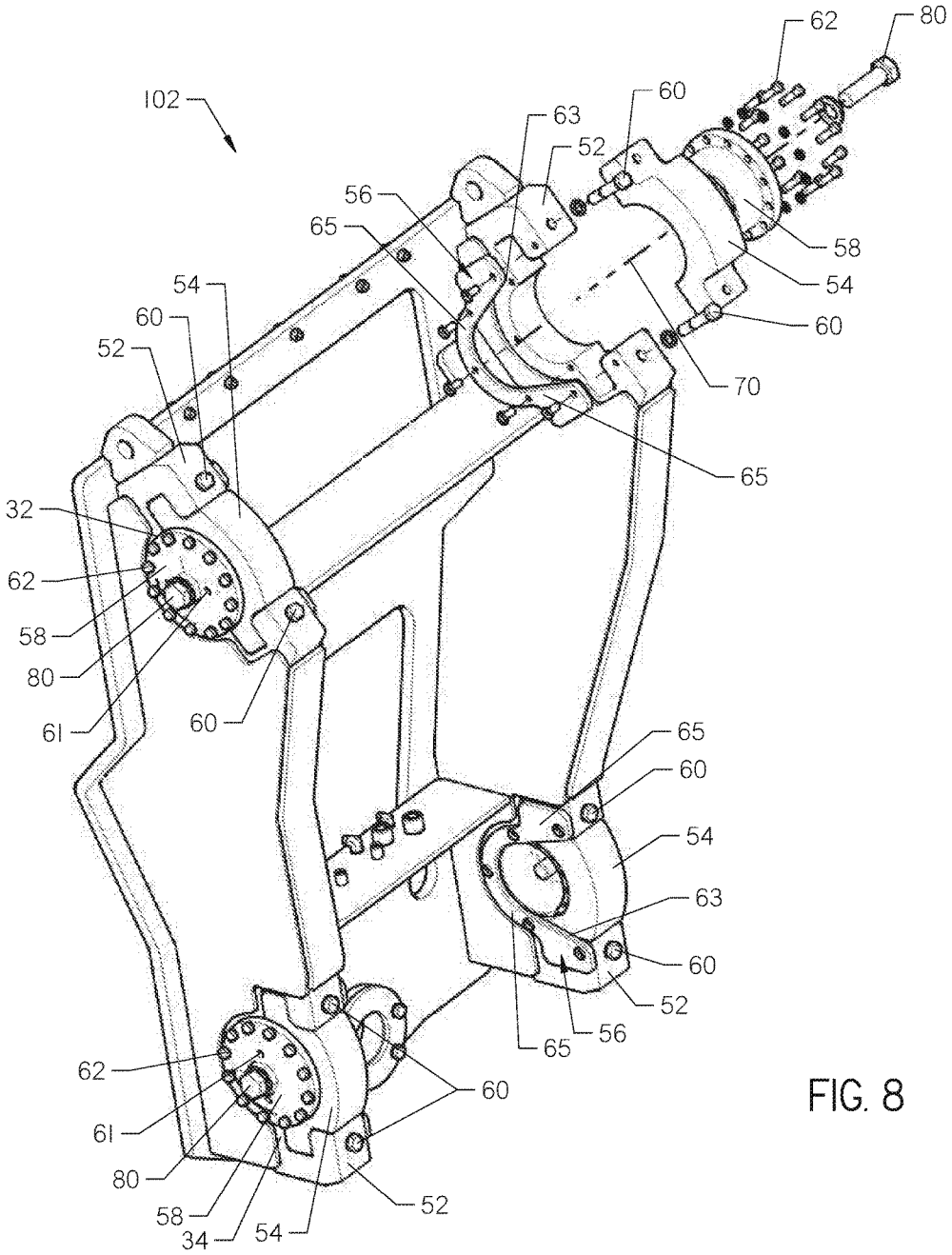
FIG. 8 is a perspective view of the coupling assembly of the work machine of FIG. 1.

With reference to FIGS. 7 and 8, the top rod 44 is secured within the top cradle 32 by cap 58. The positioning arm 20 is raised and the pivot fixture 18 (FIG. 2) is removed. The frame cylinder 27 adjusts the ground-engaging arm 15, pivoting the attachment 14 about the top cradle 32. Preferably, gravity causes the bottom rod 45 to enter the bottom cradle 34 when the arm 15 is not engaging the ground. The bottom cradle 34 and bottom rod 45 may then assembled in the same way as the top cradle 32 and the top rod 44.

With reference now to FIG. 8, a cradle array is shown. The cradle array 102 comprises the top cradle 32 and the bottom cradle 34. As shown, each side of each cradle 32, 34 has its own cap 58 and locking component 54 for fitting the rods (not shown) to the respective cradle 32, 34.

As shown, the top cradle 32 is set at an angle so that the fixed component 52 opens upwards. The bottom cradle 34 is set such that its fixed component 52 has a substantially vertical opening. While this configuration is advantageous in that it limits force on pins 60, 62 during attachment, it should not be viewed as limiting. For example, each of the cradles 32, 34 could have a substantially vertical opening. Such a configuration could prove useful if the bottom cradle 34 were joined to the attachment 14 before the top cradle 32. In that situation, an upward directed opening could ease assembly.

A coupling guide 56 is affixed to the cradles 32, 34. The coupling guide 56 centers the rods 44, 45 (FIGS. 2, 5, 6) on the cradle array 102. The coupling guide 56 is defined by an upper mouth 63 that is at least as wide as the mouth of the fixed component 52. The upper mouth 63 inwardly converges along guide elements 65. In FIG. 8, the coupling guide 56 is a U-shaped plate aligned with the fixed component 52 of the cradle, though other configurations may be used. The coupling guide 56 may be U-shaped, with each leg of the "U" serving as a guide element 65.

After the cradle array 102 of vehicle 14 is aligned with the attachment 14, the locking component 54 is slid into place within the fixed component 52 and secured with pins 60. The rods 44, 45 are then locked into place by connection of the eccentric caps 58.

In operation, a freestanding attachment 14, as shown in FIG. 2, may be coupled to the vehicle 12. The vehicle 12 is positioned with its cradle array 102 facing the rod array 104 (FIG. 2) of the attachment 14. The vehicle is operated so as to align cradle array 102 with the attachment 14. The attachment 14 is supported by the pivot fixture 18, the arm 15, and the positioning arm 20. Extension of the cylinders 25, 27 causes the positioning arm 20 and arm 15 to engage the ground. As extension continues, the attachment 14 rotates about pivot 40 and arrives at a coupling configuration, in which the top rod 44 is aligned with the top cradle 32. Once this configuration is reached extension of the cylinders 26, 27 may be halted.

The rods 44, 45 and cradles 32, 34 of the coupling assemblies 100 are secured to each other by installing cap 58 with pins 62 and rod bolt 800 and the locking component 54 with pins 60 (FIG. 8). At this point in the coupling process, the work machine 10 is in the configuration of FIG. 7. The positioning arm 20 may be raised from the ground and the pivot fixture 18 removed or retracted. The frame cylinder 27 then may raise the ground-engaging arm 15, lowering the bottom rod 45 into the bottom cradle 34. The connection between bottom rod 45 and bottom cradle 34 may be secured in the same way as top rod 44 and top cradle 32, and the coupling assembly 100 between the vehicle 12 and attachment 14 is then complete. The assembled work machine is shown in FIG. 1.

As shown in FIG. 1, while the attachment 14 and vehicle 12 are coupled, the positioning arm 20 should be maintained above ground level. Once the vehicle 12 and attachment 14 have assembled, the attachment 14 may be made operational. Thus, when the attachment 14 is a trencher, as in the Figures, the trenching chain 13 may be operated to uncover a trench. The attachment 14 should not operate during coupling and decoupling.

The work machine 10 may be decoupled into its two parts by performing the above steps in reverse. Once the positioning arm 20 has been raised, the ground-engageable arm 15 should be lowered to contact the ground. Engagement of arm 15 with the ground reduces the load on the bottom rod 45 in the bottom cradle 34. This reduced load allows the securing pins 62, eccentric cap 58, and rod bolt 80 to be safely removed from the bottom rod 45 and bottom cradle 34.

In embodiment shown in the Figures, the eccentric cap 58 has tapped holes 61 (FIG. 8). The tapped holes can be used to help free the eccentric cap 58 from a coupled rod and cradle, by allowing access to the coupled rod through the cap 58. The locking component 54 of the bottom cradle 34 is removed releasing the bottom rod 45 from the bottom cradle 34.

The frame cylinder 27 pushes the ground-engaging arm 15 against the ground, pivoting the attachment 14 about the top rod 44 as shown in FIG. 7. The attachment 14 should be pivoted far enough that the pivot fixture 18 can be installed on or lowered from the attachment 14.

Once the pivot fixture 18 has been attached, the arm 15 can be raised until the pivot foot 40 contacts the ground. Engagement of the pivot fixture 18 with the ground reduces the load on the coupled top cradle 32 and top rod 44. The reduced load on the coupled top cradle 32 and rod 44 allows the securing pins 62, eccentric cap 58, rod bolt 80 and locking component 54 to be removed. The released top rod 44 can now be moved out of the top cradle 32 by raising the arm 15 until the top rod 44 is free of the top cradle 32. Once the attachment 14 is freestanding the positioning arm 20 can be lowered to increase stability of the attachment 14 in the orientation shown in FIG. 1.

The prime mover of the attachment, motor 28, may be powered by components of the vehicle 12. Hydraulic cables or other power lines may be disconnected upon decoupling between the vehicle 12 and attachment 14.

Decoupling the vehicle 12 from the attachment 14 allows the work machine 10 to be transported in multiple pieces. Further, decoupling the attachment allows for to modularity, where vehicles 12 may be utilized with multiple attachments 14. One of skill in the art will appreciate that one could make modifications to the various parts, elements, steps and procedures described herein without departing from the spirit of the invention as defined in the following claims.

The invention claimed is:

1. An apparatus, comprising:
- a frame;
- an elongated positioning arm extending from the bottom of the frame comprising:
  - a first end pivotally attached to the frame; and
  - a second end supporting an enlarged ground-engageable shoe;
- a pivot fixture suspended from the bottom of the frame, comprising a ground-engageable pivot point at its lower extremity;
- a coupling assembly configured to join the apparatus to a self-propelled land travel vehicle; and
- a ground-engageable work attachment arm supported by the frame;
- wherein the apparatus has no ground-contacting motive elements.

2. A system comprising:
- a self-propelled land travel vehicle; and
- the apparatus of claim 1, joined to the vehicle at the coupling assembly.

3. The system of claim 2 further comprising at least one cradle attached to the vehicle to join the apparatus to the coupling assembly.

4. The system of claim 3 wherein the coupling assembly comprises a pair of parallel rods.

5. The system of claim 4 further comprising a cap for connecting one of the cradles to one of the pair of parallel rods.

6. The system of claim 5 wherein the cap defines a bore for attaching a rod bolt to one of the pair of parallel rods, wherein the bore is not disposed at a centerpoint of the cap.

7. The system of claim 3 further comprising a coupling guide affixed to the at least one cradle and having an upper mouth situated above one or more inwardly-converging guide elements.

8. The system of claim 4 wherein the at least one cradle comprises a fixed component and a locking component.

9. The system of claim 8 wherein the parallel rods are secured within the cradles when the locking component is secured to the fixed component.

10. The apparatus of claim 1 wherein a bend is formed in the arm intermediate its first and second ends.

11. The apparatus of claim 1 wherein the ground-engageable work attachment arm is an endless trenching chain.

12. The apparatus of claim 1 wherein the pivot fixture has a triangular cross sectional shape.

13. The apparatus of claim 1 wherein the pivot fixture is retractable within the frame.

14. The apparatus of claim 1 wherein the pivot fixture is removable from the frame.

15. The apparatus of claim 1 wherein the coupling assembly comprises a pair of parallel rods.

16. The apparatus of claim 15 wherein a bushing is affixed to each end of each of the rods.

17. The apparatus of claim 1 wherein the pivot fixture is suspended from the frame proximate the first end of the positioning arm.

18. A work machine comprising:
- a chassis having a rearwardly-disposed cradle assembly;
- a track frame movably supporting the chassis; and
- a work attachment connected to the cradle assembly of the chassis, the work attachment comprising:
  - a frame, wherein a portion of the frame may be actuated to engage the ground;
  - an elongated positioning arm pivotally attached to the frame at a first end comprising a ground-engageable shoe at a second end; and
  - a pivot fixture suspended from the bottom of the frame, comprising a ground-engageable pivot point at its lower extremity;
- wherein the attachment frame has no ground-contacting motive elements.

19. The work machine of claim 18 wherein the work attachment comprises a pair of spaced-apart rods disposed within the cradle assembly of the chassis.

20. The work machine of claim 18 wherein the pivot fixture is removable from the frame.

21. The work machine of claim 18 wherein the portion of the frame actuated to engage the ground is a trencher boom.

* * * * *